United States Patent [19]

Ogawa et al.

[11] Patent Number: 4,592,985

[45] Date of Patent: Jun. 3, 1986

[54] PHOTOCONDUCTIVE MEMBER HAVING AMORPHOUS SILICON LAYERS

[75] Inventors: Kyosuke Ogawa, Tokyo; Shigeru Shirai, Yamato; Keishi Saitoh, Tokyo; Teruo Misumi, Kawasaki; Junichiro Kanbe, Yokohama, all of Japan

[73] Assignee: Canon Kabushiki Kaisha, Tokyo, Japan

[21] Appl. No.: 595,436

[22] Filed: Mar. 30, 1984

[30] Foreign Application Priority Data

Apr. 2, 1983 [JP] Japan ..... 58-58349

[51] Int. Cl.[4] ..... G03G 5/082

[52] U.S. Cl. ..... 430/84; 430/95

[58] Field of Search ..... 430/57, 84, 95; 252/501.1; 427/74

[56] References Cited

U.S. PATENT DOCUMENTS 4,418,132 11/1983 Yamazaki ..... 430/57

4,465,750 8/1984 Ogawa et al. ..... 430/84

*Primary Examiner*—John L. Goodrow

*Attorney, Agent, or Firm*—Fitzpatrick, Cella, Harper & Scinto

[57] ABSTRACT

A photoconductive member, is provided which has a support, a first layer having photoconductivity containing an amorphous material comprising silicon atoms as a matrix provided on said support and a second layer containing silicon atoms and carbon atoms as essential components provided on said first layer, wherein said first layer contains at least one kind of atoms selected from the group III of the periodic table together with nitrogen atoms, with the nitrogen atoms having a substantially uniform concentration distribution within said first layer and the group III atoms of the periodic table having a depth concentration profile of said atoms with respect to the layer thickness direction having the maximum concentration at the end surface on the side of said support or in the vicinity thereof and having the concentration of said atoms tending to decrease continuously toward the second layer.

18 Claims, 12 Drawing Figures

PHOTOCONDUCTIVE MEMBER HAVING AMORPHOUS SILICON LAYERS

BACKGROUND OF THE INVENTION

1. Field of the Invention

This invention relates to a photoconductive member having sensitivity to electromagnetic waves such as light (herein used in a broad sense, including ultraviolet rays, visible light, infrared rays, X-rays and gamma-rays).

2. Description of the Prior Art

Photoconductive materials, which constitute image forming members for electrophotography in solid state image pick-up devices or in the field of image formation, or photoconductive layers in reading devices, are required to have a high sensitivity, a high SN ratio [Photocurrent $(I_p)/(I_d)$], absorption spectral characteristics matched with those of electromagnetic waves to be irradiated, a rapid response to light, a desired dark resistance value as well as no harm to human bodies during use. Further, in a solid state image pick-up device, it is also required that the residual image should easily be treated within a predetermined time. Particularly, in case of an image forming member for electrophotography to be assembled in an electrophotographic apparatus to be used in an office as a business machine, the aforesaid safety characteristic is very important.

From the standpoint as mentioned above, amorphous silicon (hereinafter referred to as a-Si) has recently attracted attention as a photoconductive material. For example, German OLS Nos. 2746967 and 2855718 disclose applications of a-Si for use in image forming members for electrophotography, and German OLS No. 2933411 discloses an application of a-Si for use in a photoelectric reader.

However, under the present situation, the photoconductive members of the prior art having photoconductive layers constituted of a-Si are further required to be improved in a balance of overall characteristics including electrical, optical and photoconductive characteristics such as dark resistance, photosensitivity and response to light, etc., and environmental characteristics during use such as humidity resistance, and further stability with lapse of time.

For instance, when the above photoconductive member is applied to an image forming member for electrophotography, residual potential is frequently observed to remain during use thereof if improvements to higher photosensitivity and higher dark resistance are intended at the same time. When such a photoconductive member is repeatedly used for a long time, there will be caused various inconveniences such as accumulation of fatigue by repeated uses or so called ghost phenomenon wherein residual images are formed.

Further, according to a large number of experiments by the present inventors, a-Si as the material constituting the photoconductive layer of an image forming member for electrophotography, while it has a number of advantages, as compared with inorganic photoconductive materials such as Se, CdS, ZnO or organic photoconductive materials such as PVCz or TNF of prior arts, is also found to have problems to be solved. Namely, when charging treatment is applied for formation of electrostatic images on the photoconductive layer of an image forming member for electrophotography having a photoconductive member constituted of a mono-layer of a-Si which has been endowed with characteristics for use in a solar battery of prior art, dark decay is markedly rapid, whereby it is difficult to apply a conventional electrophotographic process. Moreover, this tendency is further pronounced under a humid atmosphere to such an extent in some cases that no charge is retained before development time.

Further, a-Si materials may contain as constituent atoms hydrogen atoms or halogen atoms such as fluorine atoms, chlorine atoms, etc. for improving their electrical, photoconductive characteristics, boron atoms, phosphorus atoms, etc. for controlling the electroconduction type as well as other atoms for improving other characteristics. Depending on the manner in which these constituent atoms are contained, there may sometimes be caused problems with respect to electrical or photoconductive characteristics of the layer formed.

Especially, at the interface between the layers adjacent to each other, dangling bonds are liable to be formed in manufacturing process and complicated bendings are also liable to occur in energy bands. For this reason, the problems of behaviors of the charges or stability of the structure become very important, and controlling of this part is not seldom a key for having the photoconductive member exhibit its function as desired.

Also, when a-Si type photoconductive member is prepared by a method generally known in the art, various problems are caused in many cases such as insufficient life of the photocarriers generated by light irradiation of the photoconductive layer formed throughout said layer or insufficient impedance of charges injected from the support side. Accordingly, while attempting to improve the characteristics of a-Si material per se on one hand, it is also required to make efforts to obtain desired electrical and optical characteristics as mentioned above in designing of the photoconductive member on the other.

In view of the above points, the present invention contemplates the achievement obtained as a result of extensive studies made comprehensively from the standpoints of applicability and utility of a-Si as a photoconductive member for image forming members for electrophotography, solid stage image pick-up devices, reading devices, etc. It has now been found that a photoconductive member having a layer constitution comprising a photoconductive layer exhibiting photoconductivity, which is constituted of so called hydrogenated amorphous silicon, or halogen-containing hydrogenated amorphous silicon which is an amorphous material containing at least one of a hydrogen atom (H) and a halogen atom (X) in a matrix of a-Si, especially silicon atoms [hereinafter referred to comprehensively as a-Si(H,X)], said photoconductive member being prepared by designing so as to have a specific structure as hereinafter described, is found to exhibit not only practically extremely excellent characteristics but also surpass the photoconductive members of the prior art in substantially all respects, especially having markedly excellent characteristics as a photoconductive member for electrophotography.

SUMMARY OF THE INVENTION

An object of the present invention is to provide a photoconductive member for electrophotography which can easily give a high quality image which is high in density, clear in halftone and high in resolution, being free from image failure and image flow.

Another object of the present invention is to provide a photoconductive member having electrical, optical and photoconductive characteristics which are constantly stable and all-environment type will virtually no dependence on the environments under use, which member is markedly excellent in light fatigue resistance and also excellent in durability without causing deterioration phenomenon when used repeatedly, exhibiting no or substantially no residual potential observed.

Still another object of the present invention is to provide a photoconductive member having excellent electrophotographic characteristics, which is sufficiently capable of retaining charges at the time of charging treatment for formation of electrostatic charges to the extent such that a conventional electrophotographic method can be very effectively applied when it is provided for use as an image forming member for electrophotography.

Still another object of the present invention is to provide a photoconductive member having high photosensitivity, high SN ratio characteristic and good electrical contact between the laminated layers.

According to an aspect of the present invention, there is provided a photoconductive member, having a support, a first layer having photoconductivity containing an amorphous material comprising silicon atoms as a matrix provided on said support and a second layer containing silicon atoms and carbon atoms as essential components provided on said first layer, wherein said first layer contains at least one kind of atoms selected from the group III of the periodic table together with nitrogen atoms, with the nitrogen atoms having a substantially uniform concentration distribution within said first layer and the group III atoms of the periodic table having a depth concentration profile of said atoms with respect to the layer thickness direction having the maximum concentration at the end surface on the side of said support or in the vicinity thereof and having the concentration of said atoms tending to decrease continuously toward the second layer.

DETAILED DESCRIPTION OF THE PREFERRED EMBODIMENTS

Figure 1:
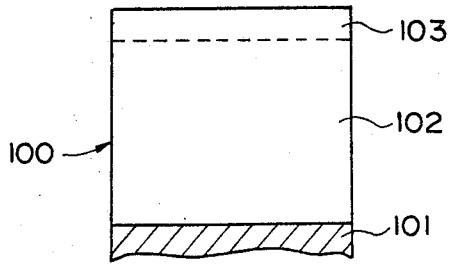
FIG. 1 shows a schematic sectional view for illustration of the layer constitution of the photoconductive member according to the present invention.

Referring now to the drawings, the photoconductive members according to the present invention are to be described in detail below.

FIG. 1 shows a schematic sectional view for illustration of the layer structure of a preferred embodiment of the constitution of the photoconductive member of this invention.

The photoconductive member 100 as shown in FIG. 1 is constituted of a first layer 102 composed preferably of a-Si(H,X) as the main component having photoconductivity formed on a support 101 for photoconductive member, and a second layer 103 containing silicon atoms and carbon atoms as the essential components formed on said first layer 102.

The nitrogen atoms take substantially uniform concentration distributions with respect to the direction substantially parallel to the support surface as well as the layer thickness direction throughout said layer. On the other hand, the group III atoms of the periodic table contained in the photoconductive layer take a concentration distribution which is uniform in the direction parallel to the support surface, but depth profile of the concentration with respect to the layer thickness has the maximum at the end surface on the side of the support, with its concentration being continuously decreased toward the second layer, as shown in FIGS. 2*a* to 2*d* (the groups III atoms of the periodic table are shown typically by boron atoms, the ordinate indicating the distance from the support, and the abscissa the atomic concentration).

Figure 2A:
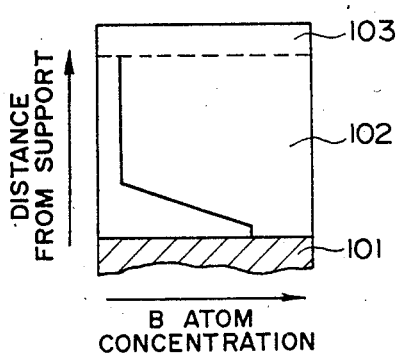
FIGS. 2*a* to 2*d* show schematic illustrations of the depth profiles of atoms of the group III of the periodic table in the first layer in the photoconductive member of the present invention.
Figure 2B:
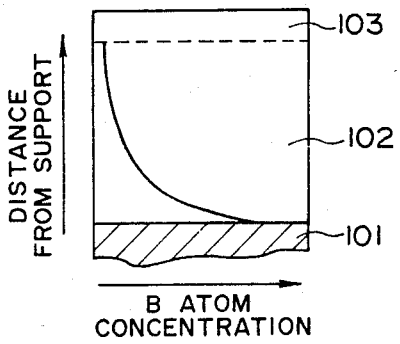
Figure 2C:
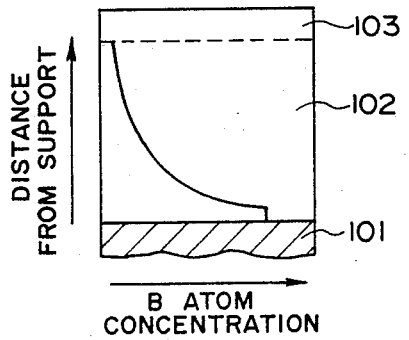
Figure 2D:
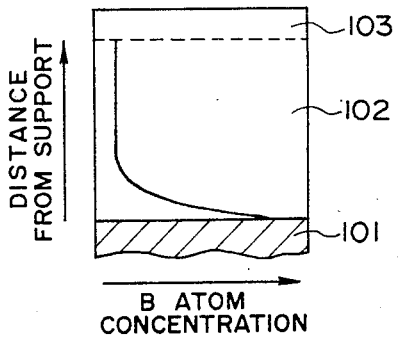

More specifically, "the depth profile with the concentration of the group III atoms of the periodic table being continuously decreased" means not only the case in which the concentration of the group III atoms of the periodic table is gradually decreased with the increase of layer thickness, as shown in FIG. 2*b*, but also the case in another Figure in which there is included a portion where the concentration is constant within an interval with respect to the layer thickness. However, the concentration of the group III atoms of the periodic table should not be changed discontinuously like steps with respect to the layer thickness. Further, the portion, having the concentration distribution maximum at the end surface on the side of said support or in the vicinity thereof, may have a certain length in the layer thickness direction or it may be only one point.

The reason why the photoconductive member of the present invention having a first layer formed so that nitrogen atoms are distributed homogeneously and the group III atoms of the periodic table are distributed as described above in the layer thickness direction can give a high quality visible image, which is high in image density, clear in half tone and high in resolution, when employed as an image forming member for electrophotography, may be estimated to be based on the synergetic effect of increased resistance of the photoconductive first layer by the nitrogen atoms contained, prevention of charge injection from the support side on account of doping of the group III atoms of the periodic table and the absence of dangling bonds or complicated bending of energy band caused by clear interface within the first layer having photoconductivity.

The substantially homogeneously distributed nitrogen atoms at the first layer may preferably be 0.005 to 40 atomic %, more preferably 0.01 to 35 atomic %, most preferably 0.5 to 30 atomic %.

On the other hand, the content of the group III atoms of the periodic table, at its concentration distribution maximum, namely at the end surface on the side of the support or its vicinity, may preferably be in the range of from 80 to $1\times10^5$ atomic ppm, more preferably from 100 to $5\times10^4$ atomic ppm, most preferably from 150 to $1\times10^4$ atomic ppm, while at its concentration distribution minimum, namely on the surface side of the photoconductive member, preferably from 1 to 1000 atomic ppm, more preferably from 5 to 700 atomic ppm, most preferably from 10 to 500 atomic ppm.

The above concentration distribution minimum and maximum may be determined appropriately within the ranges as specified above in correspondence to the concentration of nitrogen atoms, respectively, and it is desirable to increase the respective distributed concentrations according to the distributed concentration distribution of nitrogen atoms in order to accomplish more effectively the object of the present invention. The maximum of the concentration distribution should desirably be made preferably 2 times or more, more preferably 3 times or more, relative to the minimum of the concentration distribution.

In the present invention, the halogen atom (X) which may be contained in the first layer may include fluorine, chlorine, bromine and iodine, particularly preferably chlorine and above all fluorine.

The group III atoms of the periodic table to be contained in the first layer 102 may include boron, aluminum, gallium, indium and thallium, particularly preferably boron.

The support to be used in the present invention may be either electroconductive or insulating. As the electroconductive material, there may be mentioned metals such as NiCr, stainless steel, Al, Cr, Mo, Au, Nb, Ta, V, Ti, Pt, Pd etc. or alloys thereof.

As insulating support, there may conventionally be used films or sheets of synthetic resins, including polyester, polyethylene, polycarbonate, cellulose acetate, polypropylene, polyvinyl chloride, polyvinylidene chloride, polystyrene, polyamide, etc., glass, ceramics, paper and so on. These insulating supports preferably have at least one surface subjected to electroconduction treatment, and it is desirable to provide other layers on the side which has undergone said electroconduction treatment.

For example, electroconduction treatment of a glass can be effected by providing a thin film of NiCr, Al, Cr, Mo, Au, Ir, Nb, Ta, V, Ti, Pt, Pd, $In_2O_3$, $SnO_2$, ITO ($In_2O_3+SnO_2$) thereon. Alternatively, a synthetic resin film such as polyester film can be subjected to the electroconduction treatment on its surface by vacuum vapor deposition, electron-beam deposition or sputtering of a metal such as NiCr, Al, Ag, Pb, Zn, Ni, Au, Cr, Mo, Ir, Nb, Ta, V, Ti, Pt, etc. or by laminating treatment with said metal, thereby imparting electroconductivity to the surface.

The support may be shaped in any form such as cylinders, belts, plates or others, and its form may be determined as desired. For example, when the photoconductive member 100 in FIG. 1 is to be used as an image forming member for electrophotography, it may desirably be formed into an endless belt or a cylinder for use in continuous high speed copying. The support may have a thickness, which is conveniently determined so that a photoconductive member as desired may be formed. When the photoconductive member is required to have flexibility, the support is made as thin as possible, so far as the function of a support can be exhibited. However, in such a case, the thickness is preferably 10 μm or more from the points of fabrication and handling of the support as well as its mechanical strength.

In the present invention, formation of the first layer constituted of a-Si(H,X) may be conducted according to the vacuum deposition method utilizing discharging phenomenon, such as glow discharge method, sputtering method or ion-plating method.

For example, for formation of the first layer constituted of a-Si(H,X) according to the glow discharge method, the basic procedure comprises introducing a starting gas for Si supply capable of supplying silicon atoms (Si) together with a starting gas for introduction of hydrogen atoms (H) and/or halogen atoms (X) and also a starting gas for introduction of nitrogen atoms (N) and a starting gas for introduction of the group III atoms of the periodic table depending on the constituent atom composition of the layer region to be formed together with an inert gas such as Ar, He, etc., if desired, at predetermined mixing ratio and flow rates into the deposition chamber which can be internally brought to a reduced pressure, and forming a plasma atmosphere of these gases by exciting glow discharge in said deposition chamber, thereby forming a layer consisting of a-Si(H,X) on the surface of a support set at a predetermined position.

Alternatively, for formation of the first layer according to the sputtering method, a gas for introduction of hydrogen atoms (H) and/or halogen atoms (X) and also a starting gas for introduction of nitrogen atoms (N) and a starting gas for introduction of the group III atoms of the periodic table depending on the constituent atom composition of the layer region to be formed may be introduced into the deposition chamber for sputtering when sputtering a target constituted of Si in an atmosphere of an inert gas such as Ar, He or a gas mixture based on these gases.

The starting gas for supplying Si to be used for formation of the first layer in the present invention may include gaseous or gasifiable hydrogenated silicons (silanes) such as $SiH_4$, $Si_2H_6$, $Si_3H_8$, $Si_4H_{10}$ and others as effective materials. In particular, $SiH_4$ and $Si_2H_6$ are preferred with respect to easy handling during layer formation and efficiency for supplying Si.

In the present invention, for introduction of hydrogen atoms into the first layer, it is generally practiced to supply a gas primarily of $H_2$ or hydrogenated silicon such as $SiH_4$, $Si_2H_6$, $Si_3H_8$ of $Si_4H_{10}$ as mentioned above into a deposition and excite discharging therein.

Effective starting gases for introduction of halogen atoms to be used for formation of the first layer in the present invention may include a large number of halogen containing compounds, namely gaseous or gasifiable halogen compounds as exemplified preferably by halogen gases, halides, interhalogen compounds, silane derivatives substituted with halogens. Further, there may also be included gaseous or gasifiable silicon compounds containing halogen atoms constituted of silicon atoms and halogen atoms as constituent elements as effective ones in the present invention.

Typical examples of halogen compounds preferably used for formation of the first layer in the present invention may include halogen gases such as of fluorine, chlorine, bromine or iodine, interhalogen compounds such as BrF, ClF, $ClF_3$, $BrF_3$, $BrF_5$, $IF_3$, $IF_7$, ICl, IBr, etc.

As the silicon compounds containing halogen atoms, namely so called silane derivatives substituted with halogens, there may preferably be employed silicon halides such as $SiF_4$, $Si_2F_6$, $SiCl_4$, $SiBr_4$ and the like.

As the starting gas when introducing halogen atoms into the first layer, the halogen compounds or halo-containing silicon compounds as mentioned above may be effectively used. In addition, it is also possible to use gaseous or gasifiable halides containing hydrogen atom as one of the constituents, including hydrogen halides such as HF, HCl, HBr, HI, etc., halo-substituted hydrogenated silicon such as $SiH_2F_2$, $SiH_2I_2$, $SiH_2Cl_2$, $SiHCl_3$, $SiH_2Br_2$, $SiHBr_3$, etc. as effective starting materials for formation of the first layer.

These halides containing hydrogen atom can introduce hydrogen atoms which are very effective components for controlling electrical and photoelectric characteristics into the layer during formation of the first layer, simultaneously with introduction of halogen atoms, and therefore they can be used as preferably starting materials for introduction of halogen atoms in the present invention.

As the starting gas for supplying nitrogen atoms to be used for formation of the first layer in the present invention, there may be employed gaseous or gasifiable nitrogen, nitrogen compounds such as nitrides or azides containing N as constituent atom such as nitrogen ($N_2$), ammonia ($NH_3$), hydrazine ($H_2NNH_2$), hydrogen azide ($HN_3$), ammonium azide ($NH_4N_3$) and the like. Further, as the compounds which can introduce also halogen atoms in addition to nitrogen atoms, halogenated nitrogen compounds such as nitrogen trifluoride ($F_3N$), nitrogen tetrafluoride ($F_4N_2$) and the like are also available.

As the starting gas for supplying the group III atoms of the periodic table to be used for formation of the first layer in the present invention, there may be included $B_2H_6$, $B_4H_{10}$, $B_5H_9$, $B_5H_{11}$, $B_6H_{10}$, $GaCl_3$, $AlCl_3$, $BF_3$, $BCl_3$, $BBr_3$, $BI_3$, and the like.

For formation of the first layer comprising a-Si(H,X) according to the reaction sputtering method or the ion plating method, for example, in the case of the sputtering method, a target comprising Si may be used and sputtering of this target is effected in a certain gas plasma atmosphere. Alternatively, in the case of the ion plating method, a polycrystalline silicon or single crystalline silicon is placed as the vaporizing source in a vapor deposition boat, and the vaporizing source is vaporized by heating according to the resistance heating method or the electron beam method (EB method) to be permitted to fly and pass through a certain gas plasma atmosphere.

Both in the sputtering method and in the ion plating method, introduction of desired atoms into the first layer formed may be effected by introducing a gas for introduction of hydrogen atoms (H) and/or halogen atoms (X) together with a starting gas for introduction of nitrogen atoms (N) and a starting gas for introduction of the group III atoms of the periodic table, containing also an inert gas such as He, Ar, etc., if desired, into the deposition chamber for sputtering or ion-plating and forming a plasma atmosphere of said gas.

For controlling the contents of hydrogen atoms, halogen atoms, nitrogen atoms, or the group III atoms of the periodic table in the first layer, at least one kind of the amount of the starting material to be introduced into the deposition chamber for incorporation of hydrogen atoms (H), halogen atoms (X), nitrogen atoms (N) or the group III atoms of the periodic table, the support temperature, discharging power, etc. may be controlled.

In the present invention, as the diluting gas to be used in forming the first layer by means of the glow discharge or the sputtering, so called rare gases, such as He, Ne, Ar, etc. may be preferably used.

The second layer 103 formed on the first layer 102 has a free surface and is provided mainly for the purpose of accomplishing the objects of the present invention with respect to humidity resistance, continuous and repeated use characteristics, electric pressure resistance, environmental characteristics during use, and durability.

In the photoconductive member, since each of the first and the second layers has the common constituent of silicon atom, chemical stabilities are sufficiently ensured at the lamination interface.

The second layer 103 is constituted of an amorphous material comprising silicon atoms (Si), carbon atoms (C) and optionally hydrogen atoms (H) and/or halogen atoms (X) [hereinafter written as "a-$(Si_xC_{1-x})_y(H,X)_{1-y}$", where $0<x, y<1$].

Formation of the second layer constituted of a-$(Si_xC_{1-x})_y(H,X)_{1-y}$ may be performed by means of glow discharge, sputtering, ion implantation, ion plating, electron beam method, etc. These preparation methods may be suitably selected depending on various factors such as preparation conditions, degree of the load for capital investment for installations, the production scale, the desirable characteristics required for the photoconductive member to be prepared, etc. For the advantages of relatively easy control of the conditions for preparing photoconductive members having desired characteristics and easy introduction of silicon atoms and carbon atoms, optionally together with hydrogen atoms or halogen atoms, into the second layer to be prepared, there may preferably be employed the glow discharge method or the sputtering method. Further, in the present invention, the second layer 305 may be formed by using the glow discharge method and the sputtering method in combination in the same device system.

For formation of the second layer by means of glow discharge, starting gases for formation of a-$(Si_xC_{1-x})_y(H,X)_{1-y}$, optionally mixed at a predetermined mixing ratio with diluting gas, may be introduced into a deposition chamber for vacuum deposition in which a support having the photoconductive first layer formed thereon is placed, and the gas introduced is made into a gas plasma by excitation of glow discharging, thereby depositing a-$(Si_xC_{1-x})_y(H,X)_{1-y}$ on the first layer which has already been formed on the aforesaid support.

As the starting gases for formation of a-$(Si_xC_{1-x})_y(H,X)_{1-y}$ to be used in the present invention, it is possible to use most of gaseous substances or gasified substances containing at least one of silicon atoms (Si), carbon atoms (C), hydrogen atoms (H) and halogen atoms (X) as constituent atoms.

In case when a starting gas containing Si as one of the constituent atoms mentioned above is employed, there may be employed, for example, a mixture of a starting gas containing Si as a constituent atom, a starting gas containing C as constituent atoms, and optionally a starting gas containing H as constituent atom and/or a starting gas containing X as constituent atom, if desired, at a desired mixing ratio, or alternatively a mixture of a starting gas containing Si as constituent atoms with a starting gas containing C and H as constituent atoms also at a desired mixing ratio, or a mixture of a starting gas containing Si as constituent atom with a gas containing three atoms of Si, C and H or of Si, C and X as constituent atoms at a desired mixing ratio.

Alternatively, it is also possible to use a mixture of a starting gas containing Si and H as constituent atoms with a starting gas containing C as a constituent atom or a mixture of a starting gas containing Si and X as constituent atoms with a starting gas containing C as a constituent atom.

In the present invention, preferable halogen atoms (X) to be contained in the second layer are F, Cl, Br and I, particularly preferably F and Cl.

In the present invention, the compounds which can be effectively used as starting gases for formation of the second layer may include hydrogenated silicon gases containing Si and H as constituent atoms such as silanes (e.g. $SiH_4$, $Si_2H_6$, $Si_3H_8$, $Si_4H_{10}$, etc ); compounds containing C and H as constituent atoms such as saturated hydrocarbons having 1 to 4 carbon atoms, ethylenic hydrocarbons having 2 to 4 carbon atoms and acetylenic hydrocarbons having 2 to 4 carbon atoms; simple halogens; hydrogen halides; interhalogen compounds; silicon halides; and halo-substituted hydrogenated silicon.

More specifically, there may be included, as saturated hydrocarbons, methane, ethane, propane n-butane, pentane; as ethylenic hydrocarbons, ethylene, propylene, butene-1, butene-2, isobutylene, pentene; as acetylenic hydrocarbons, acetylene, methyl acetylene, butyne; as single halogen substances, halogen gases such as of fluorine, chlorine, bromine and iodine, as hydrogen halides, HF, HI, HCl, HBr; as interhalogen compounds, ClF, $ClF_3$, $ClF_5$, BrF, $BrF_3$, $BrF_5$, $IF_5$, $IF_7$, ICl, IBr; as silicon halides, $SiF_4$, $Si_2F_6$, $SiCl_4$, $SiCl_3Br$, $SiCl_2Br_2$, $SiClBr_3$, $SiCl_3I$, $SiBr_4$, as halo-substituted hydrogenated silicon, $SiH_2F_2$, $SiH_2Cl_2$, $SiHCl_3$, $SiH_3Cl$, $SiH_3Br$, $SiH_2Br_2$, $SiHBr_3$, etc.; and so on.

In addition to these materials, there may also be employed halo-substituted paraffinic hydrocarbons such as $CF_4$, $CCl_4$, $CBr_4$, $CHF_3$, $CH_2F_2$, $CH_3F$, $CH_3Cl$, $CH_3Br$, $CH_3I$, $C_2H_5Cl$ and the like, fluorinated sulfur compounds such as $SF_4$, $SF_6$ and the like; alkyl silanes such as $Si(CH_3)_4$, $Si(C_2H_5)_4$, etc.; halo-containing alkyl silanes such as $SiCl(CH_3)_3$, $SiCl_2(CH_3)_2$, $SiCl_3CH_3$ and the like, as effective materials.

These materials for forming the second layer may be selected and employed as desired during formation of the second layer so that silicon atoms, carbon atoms and optionally halogen atoms and/or hydrogen atoms may be contained at a desired composition ratio in the second layer to be formed.

For example, $Si(CH_3)_4$ capable of incorporating easily silicon atoms, carbon atoms and hydrogen atoms and forming a layer with desired characteristics together with a material for incorporation of halogen atoms such as $SiHCl_3$, $SiH_2Cl_2$, $SiCl_4$ or $SiH_3Cl$, may be introduced at a certain mixing ratio under gaseous state into a device for formation of the second layer, wherein glow discharging is excited thereby to form a second layer comprising a-$(Si_xC_{1-x})_y(H,X)_{1-y}$.

For formation of the second layer by means of sputtering, a single crystalline or polycrystalline Si wafer and/or C wafer or a wafer containing Si and C mixed therein is used as a target and subjected to sputtering in an atmosphere of various gases containing, if desired, halogen atoms or/and hydrogen atoms as constituent atoms.

For example, when Si wafer is used as the target, a starting gas for introducing C and H or/and X, which may be diluted with a diluting gas, if desired, is introduced into a deposition chamber for the sputter to form a gas plasma therein and effect sputtering of said Si wafer.

Alternatively, Si and C as separate targets or one sheet target of a mixture of Si and C can be used and sputtering is effected in a gas atmosphere containing, if necessary, hydrogen atoms or/and halogen atoms. As the starting gas for introduction of C, H and X, there may be employed the materials for formation of the second layer as mentioned in the glow discharge as described above as effective gases also in case of sputtering.

In the present invention, as the diluting gas to be used in forming the second layer by glow discharge or sputtering, there may preferably employed so called rare gases such as He, Ne, Ar and the like.

The second layer should be carefully formed so that the required characteristics may be given exactly as desired.

More specifically, a substance containing as constituent atoms Si, C and, if necessary, H or/and X can take various forms from crystalline to amorphous, electrical properties from conductive through semiconductive to insulating, and photoconductive properties from photoconductive to non-photoconductive depending on the preparation conditions. Therefore, in the present invention, the preparation conditions are strictly selected as desired so that there may be formed a-$(Si_xC_{1-x})_y(H,X)_{1-y}$ having desired characteristics depending on the purpose. For example, when the second layer is to be provided primarily for the purpose of improvement of electrical pressure resistance, a-$(Si_xC_{1-x})_y(H,X)_{1-y}$ is prepared as an amorphous material having marked electric insulating behaviours under the usage conditions.

Alternatively, when the primary purpose for provision of the second layer is improvement of continuous repetitive use characteristics or environmental use characteristics, the degree of the above electric insulating property may be alleviated to some extent and a-$(Si_xC_{1-x})_y(H,X)_{1-y}$ may be prepared as an amorphous material having sensitivity to some extent to the light irradiated.

In forming the second layer comprising a-$(Si_xC_{1-x})_y(H,X)_{1-y}$ on the surface of the first layer, the substrate temperature during layer formation is an important factor having influences on the structure and the characteristics of the layer to be formed, and it is desired in the present invention to control severely the support temperature during layer formation so that a-$(Si_xC_{1-x})_y(H,X)_{1-y}$ having intended characteristics may be prepared as desired.

As the support temperature in forming the second layer for accomplishing effectively the objects in the present invention, there may be selected suitably the optimum temperature range in conformity with the method for forming the second layer in carrying out formation of the second layer. Preferably, however, the support temperature may be 20° to 400° C., more preferably 50° to 350° C., most preferably 100° to 300° C. For formation of the second layer, the glow discharge method or the sputtering method may be advantageously adopted, because severe control of the composition ratio of atoms constituting the layer or control of layer thickness can be made with relative ease as compared with other methods. In case when the second layer is to be formed according to these layer forming methods, the discharging power during layer formation is one of important factors influencing the characteristics of a-$(Si_xC_{1-x})_y(H,X)_{1-y}$ to be prepared, similarly as the aforesaid support temperature.

The discharging power condition for preparing effectively a-$(Si_xC_{1-x})_y(H,X)_{1-y}$ having characteristics for accomplishing the objects of the present invention with good productivity may preferably be 10 to 300 W, more preferably 20 to 250 W, most preferably 50 to 200 W.

The gas pressure in a deposition chamber may preferably be 0.01 to 1 Torr, more preferably 0.1 to 0.5 Torr.

In the present invention, the above numerical ranges may be mentioned as preferable numerical ranges for the support temperature, discharging power, etc. for preparation of the second layer. However, these factors for layer formation should not be determined separately or independently of each other, but it is desirable that the optimum values of respective layer forming factors should be determined based on mutual organic relationships so that a second amorphous layer comprising a-$(Si_xC_{1-x})_y(H,X)_{1-y}$ having desired characteristics may be formed. The content of carbon atoms in the second layer in the photoconductive member of the present invention is one of the important factors for obtaining the desired characteristics to accomplish the objects of the present invention, similarly as the conditions for preparation of the second layer.

The content of carbon atoms contained in the second layer in the present invention is determined appropriately as desired depending on the characteristics of the amorphous material constituting the second layer.

More specifically, the amorphous material represented by the above formula a-$(Si_xC_{1-x})_y(H,X)_{1-y}$ may be classified broadly into an amorphous material constituted of silicon atoms and carbon atoms (hereinafter written as "a-$Si_aC_{1-a}$", where $0<a<1$), an amorphous material constituted of silicon atoms, carbon atoms and hydrogen atoms (hereinafter written as "a-$(Si_bC_{1-b})_cH_{1-c}$", where $0<b$, $c<1$) and an amorphous material constituted of silicon atoms, carbon atoms and halogen atoms and optionally hydrogen atoms (hereinafter written as "a-$(Si_dC_{1-d})_e(H,X)_{1-e}$", where $0<d$, $e<1$).

In the present invention, the content of carbon atoms contained in the second layer, when it is constituted of a-$Si_aC_{1-a}$, may be prefereably in the range from $1\times10^{-3}$ to 90 atomic %, more preferably 1 to 80 atomic %, most preferably 10 to 75 atomic %. That is, in terms of the aforesaid representation a in the formula a-$Si_aC_{1-a}$, a may be preferably 0.1 to 0.99999, more preferably 0.2 to 0.99, most preferably 0.25 to 0.9.

On the other hand, in the present invention, when the second layer is constituted of a-$(Si_bC_{1-b})_cH_{1-c}$, the content of carbon atoms contained in the second layer may be preferably $1\times10^{-3}$ to 90 atomic %, more preferably 1 to 90 atomic %. The content of hydrogen atoms may be preferably 1 to 40 atomic %, more preferably 2 to 35 atomic %, most preferably 5 to 30 atomic %. A photoconductive member formed to have a hydrogen atom content within these ranges is sufficiently applicable as an excellent one in practical applications.

That is, in terms of the representation by a-$(Si_bC_{1-b})_cH_{1-c}$, b may be preferably 0.1 to 0.99999, preferably 0.1 to 0.99, most preferably 0.15 to 0.9, and c preferably 0.6 to 0.99, preferably 0.65 to 0.98, most preferably 0.7 to 0.95.

When the second layer is constituted of a-$(Si_dC_{1-d})_e(H,X)_{1-e}$, the content of carbon atoms contained in the second layer may be preferably $1\times10^{-3}$ to 90 atomic %, more preferably 1 to 90 atomic %, most preferably 10 to 80 atomic %. The content of halogen atoms may be preferably 1 to 20 atomic %, more preferably 1 to 18 atomic %, most preferably 2 to 15 atomic %. A photoconductive member formed to have a halogen atom content with these ranges is sufficiently applicable as an excellent one in practical applications. The content of hydrogen atoms to be optionally contained may be preferably 19 atomic % or less, more preferably 13 atomic % or less.

That is, in terms of the representation by a-$(Si_dC_{1-d})_e(H,X)_{1-e}$, d may be preferably 0.1 to 0.99999, preferably 0.1 to 0.99, most preferably 0.15 to 0.9 and e preferably 0.8 to 0.99, more preferably 0.82 to 0.99, most preferably 0.85 to 0.98.

The range of the numerical value of layer thickness of the second layer should desirably be determined depending on the intended purpose so as to effectively accomplish the objects of the present invention.

The layer thickness of the second layer is required to be determined as desired suitably with due considerations about the relationships with the contents of carbon atoms in the second layer, the layer thickness of the first layer, as well as other organic relationships with the characteristics required for respective layers. In addition, it is also desirable to have considerations from economical point of view such as productivity or capability of bulk production.

The second layer in the present invention is desired to have a layer thickness preferably of 0.003 to 30 μm, more preferably 0.004 to 20 μm, most preferably 0.005 to 10 μm.

The content of carbon atoms contained in the second layer can be controlled by, for example, according to the glow discharge method, controlling the flow rate of the gas for introduction of carbon atoms when introduced into the deposition chamber. In the case of layer formation according to the sputtering method, the sputtering area ratio of the silicon wafer to graphite wafer may be varied during formation of the target or the mixing ratio of silicon powder to graphite powder may be changed before molding into a target, whereby the content of carbon atoms can be controlled as desired.

The content of the halogen atoms in the second layer can be controlled by controlling the flow rate of the gaseous starting material for introduction of halogen atoms when introduced into the deposition chamber.

The photoconductive member of the present invention designed to have layer constitution as described above can overcome all of the problems as mentioned above and exhibit very excellent electrical, optical, photoconductive characteristics, as well as good environmental characteristics in use.

In particular, when it is applied as an image forming member for electrophotography, it is excellent in charge retentivity in charging treatment without any influence of residual potential on image formation at all, being stable in its electrical properties with high sensitivity and having high SN ratio, whereby it is possible to obtain repeatedly visible images of high quality with high density, clear halftone and high resolution, and further excellent in light fatigue resistance and repeated usage characteristics, particularly in repeated usage characteristics under highly humid atmosphere.

Next, an example of the process for producing the photoconductive member according to the glow discharge decomposition method is to be described.

Figure 3:
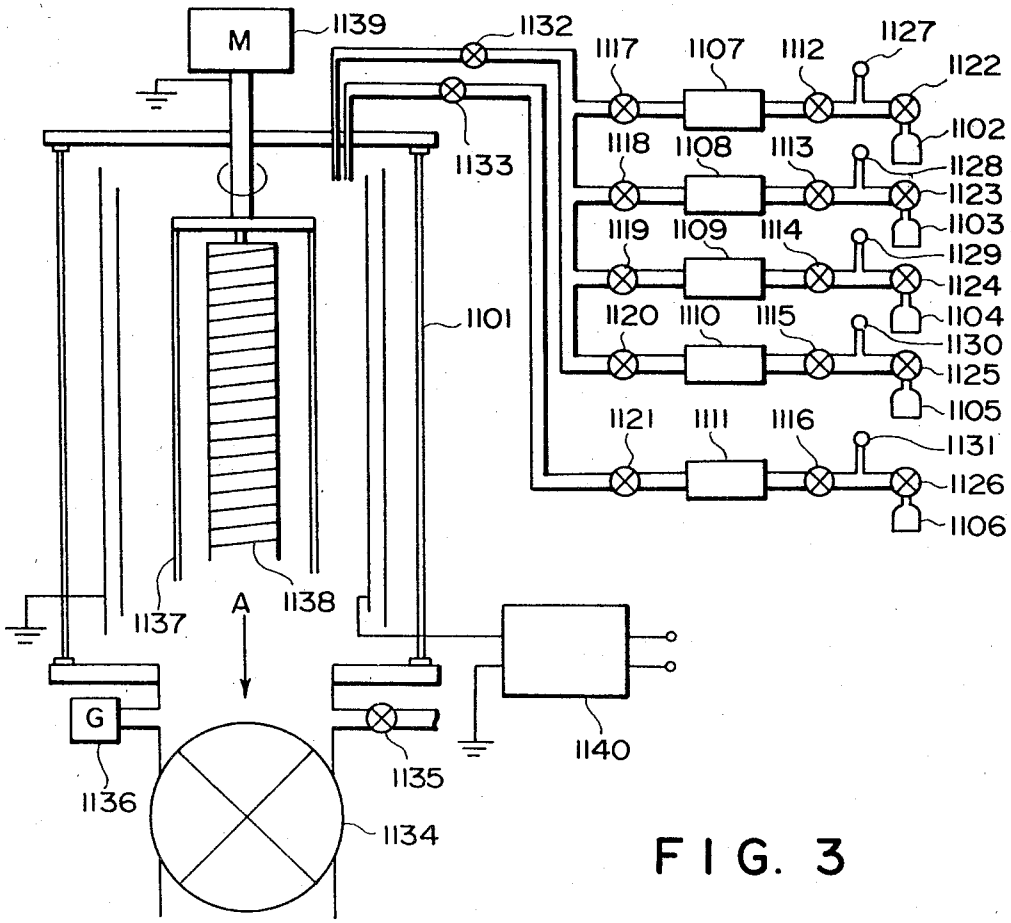
FIG. 3 shows a device for preparing the photoconductive member according to the glow discharge decomposition method.

FIG. 3 shows a device for producing a photoconductive member according to the glow discharge decomposition method.

In the gas bombs 1102–1106, there are hermetically contained starting gases for formation of respective layers for the photoconductive member of the present invention. For example, 1102 is a bomb containing $SiH_4$ gas (purity: 99.99%), 1103 is a bomb containing $B_2H_6$ gas diluted with $H_2$ (purity: 99.99%, hereinafter abbreviated as "$B_2H_6/H_2$"), 1104 is a $NH_3$ gas bomb (purity: 99.99%), 1105 is a $CH_4$ gas bomb (purity: 99.99%) and 1106 is a $SiF_4$ gas bomb (purity: 99.99%). Other than these, although not shown in the drawing, it is also possible to provide additional bombs of desired gas species, if necessary.

For allowing these gases to flow into the reaction chamber 1101, on confirmation of the valves 1122–1126 of the gas bombs 1102–1106 and the leak valve 1135 to be closed, and the inflow valves 1112–1116, the outflow valves 1117–1121 and the auxiliary valves 1132 and 1133 to be opened, the main valve 1134 is first opened to evacuate the reaction chamber 1101 and the gas pipelines. As the next step, when the reading on the vacuum indicator 1136 becomes $5\times10^{-6}$ Torr, the auxiliary valves 1132 and 1133 and the outflow valves 1117–1121 are closed. Then, $SiH_4$ gas from the gas bomb 1102, $B_2H_6/H_2$ gas from the gas bomb 1103, $NH_3$ gas from the gas bomb 1104, $CH_4$ gas from the gas bomb 1105, and $SiF_4$ gas from the gas bomb 1106 are permitted to flow into the mass-flow controllers 1107–1111, respectively, by controlling the pressures at the outlet pressure gauges 1127–1131 to 1 $Kg/cm^2$, respectively, by opening the valves 1122–1126 and opening gradually inflow valves 1112–1116. Subsequently, the outflow valves 1117–1121 and the auxiliary valves 1132 and 1133 are gradually opened to permit respective gases to flow into the reaction chamber 1101. The outflow valves 1117–1121 are controlled so that the flow rate ratio of the respective gases may have a desired value and opening of the main valve 1134 is also controlled while watching the reading on the vacuum indicator 1136 so that the pressure in the reaction chamber may reach a desired value. And, after confirming that the temperature of the support cylinder 1137 is set at 50°–400° C. by the heater 1138, the power source 1140 is set at a desired power to excite glow discharge in the reaction chamber 1101.

At the same time, $B_2H_6/H_2$ gas flow rate is suitably changed so that the boron atom content curve previously designed may be obtained, and discharging power and the support temperature may be controlled, if desired, in the sense to adjust the plasma conditions changed corresponding to the change in said gas flow rate, to form the first layer.

During the layer formation, in order to effect uniformization of layer formation, the support cylinder 1137 is rotated at a constant speed by means of a motor 1139.

As the next step, all the gas operating system valves are closed, and the reaction chamber 1101 is once evacuated to a high vacuum. When the reading on the vacuum indicator becomes about $5\times10^{-6}$ Torr, the same operations as in the above case are repeated. That is, the operational system valves of $SiH_4$, $CH_4$ and optionally a diluting gas such as He, if necessary, are opened to control the flow rates of respective gases to desired values, followed by excitation of glow discharge as in the case of the first layer formation, thus forming a second layer. For incorporation of halogen atoms in the second layer, the operational valve for $SiF_4$ is opened at the same time, followed by excitation of glow discharge.

The following Examples are set forth for further illustration of the present invention.

EXAMPLE 1

Figure 4:
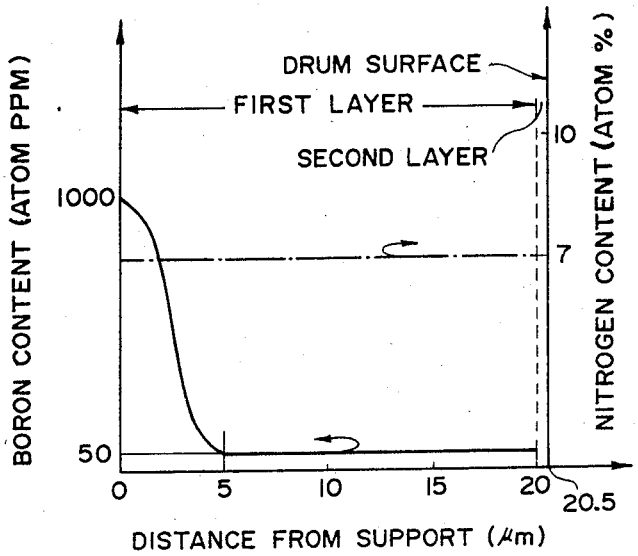
FIGS. 4, 5 and 7 to 9 illustrate the analytical results of the depth profile of the constituent atoms in the photoconductive layer in Examples of the present invention.

By means of the device for preparation of photoconductive member as shown in FIG. 3, respective layers were formed on a cylinder made of aluminum according to the glow discharge decomposition method as previously described under the preparation conditions as shown in Table 1. A part of the drum-shaped photoconductive member was cut, and quantitative determinations of the concentrations of boron atoms and nitrogen atoms in the direction of layer thickness were practiced by use of a secondary ion mass analyzer to obtain the results of the depth profiles as shown in FIG. 4. Also, the residual part of the photoconductive member drum was set in an electrophotographic device, and the latent image was formed under a charging corona voltage of +⑥ KV and an image exposure of 0.8–1.5 lux.sec, followed subsequently by respective processes of developing, transfer and fixing according to known methods, and the image thus obtained was evaluated. Image evaluation was performed by practicing image formation corresponding in total number to 100,000 sheets with use of A4 size papers under normal environment and further practicing image formation corresponding to 100,000 sheets under high temperature and high humidity environment, and every sample per 10,000 sheets was evaluated for its superiority or inferiority in terms of density, resolution, gradation reproducibility, image defect, etc. As the result, not depending on the environmental conditions and the number of sheets of successive copying, very good evaluations were obtained for all of the items as mentioned above. In particular, marked results were obtained in the item of density and it was confirmed that images with very high density could be obtained. This is also supported by the results of measurement of potentials. For example, as compared with a sample having no nitrogen added, the receiving potential was found to be improved by about 1.5 to 2 times. Improvement of charge receiving ability afforded not only increased image density but also a latitude with wide corona conditions, thus having a great advantage of enlarged scope in choice of image quality.

Also, with respect to image defect, very good results were obtained. This may be considered to be due to the effect of the depth profile of boron atoms as shown in FIG. 4 in which there is the maximum concentration portion in the amorphous layer near the support, and the difference from a member having no such boron depth profile could be distinctly observed.

EXAMPLE 2

Figure 5:
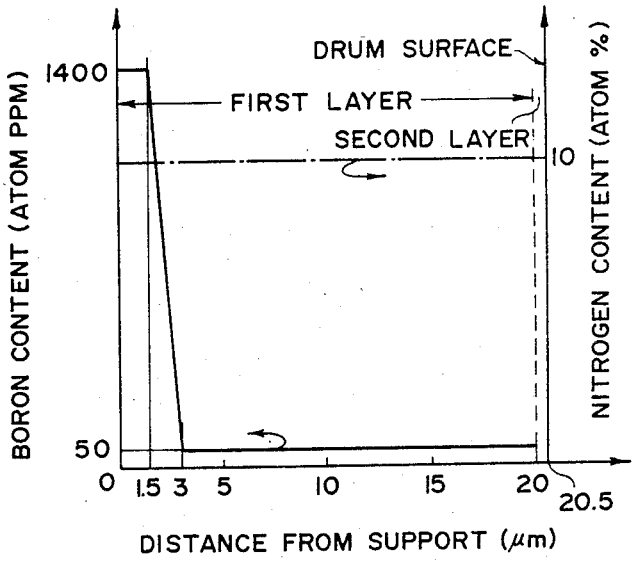

Drum-shaped photoconductive members were prepared according to the same procedure as in Example 1 except that the concentration of nitrogen atoms and the depth profile of boron atoms were changed. The details of the preparation conditions are shown in Table 2. Analysis of the constituent atom concentrations and image evaluations were practiced for these light receiving members similarly as in Example 1. As the result, the results of depth profiles of nitrogen atoms and boron atoms as shown in FIG. 5 were obtained. As for image evaluation, good results similar to Example 1 were also obtained.

COMPARATIVE EXAMPLE 1 AND EXAMPLES 3–5

Figure 6:
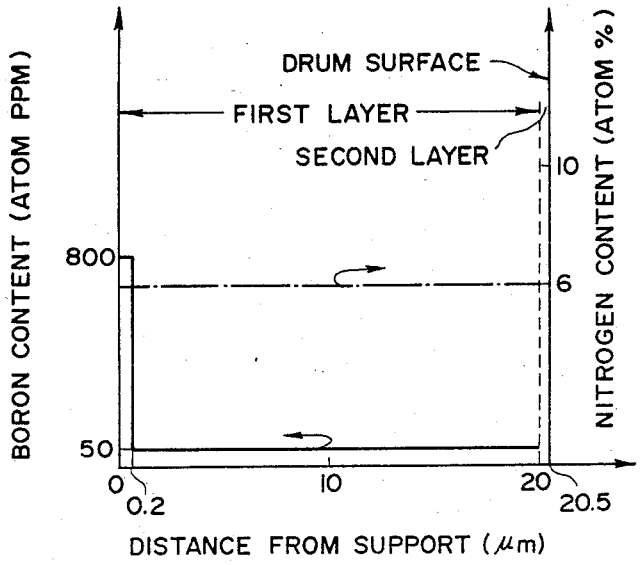
FIG. 6 illustrates the analytical result of the depth profile of the constituent atoms in the photoconductive layer in Comparative example.
Figure 7:
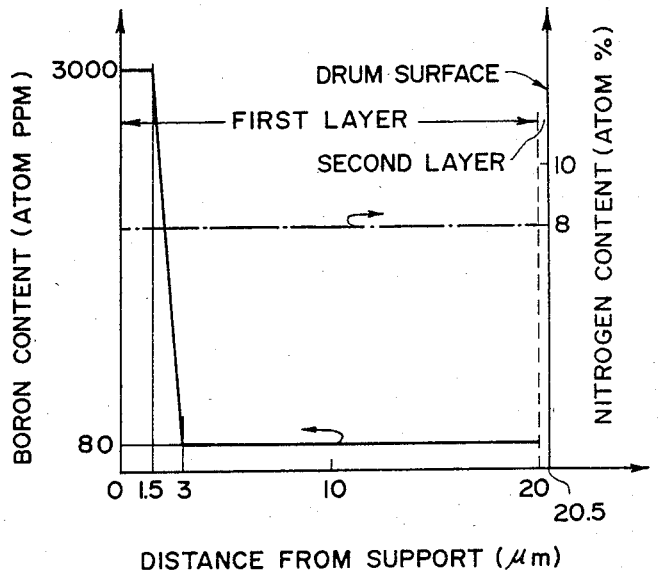
Figure 8:
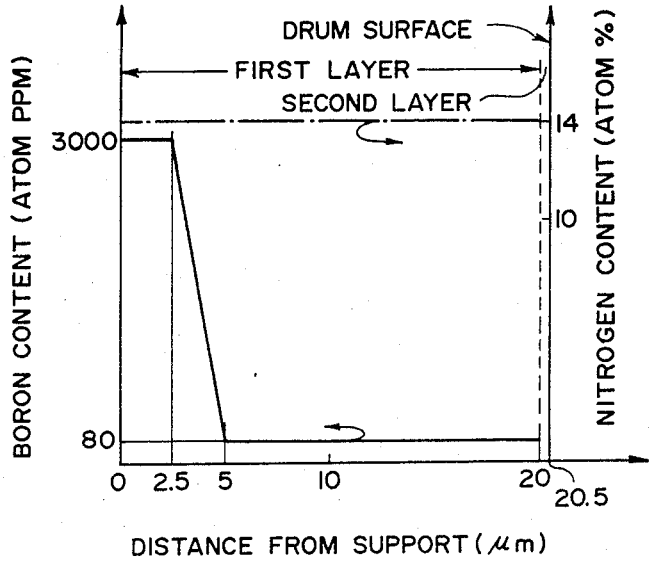
Figure 9:
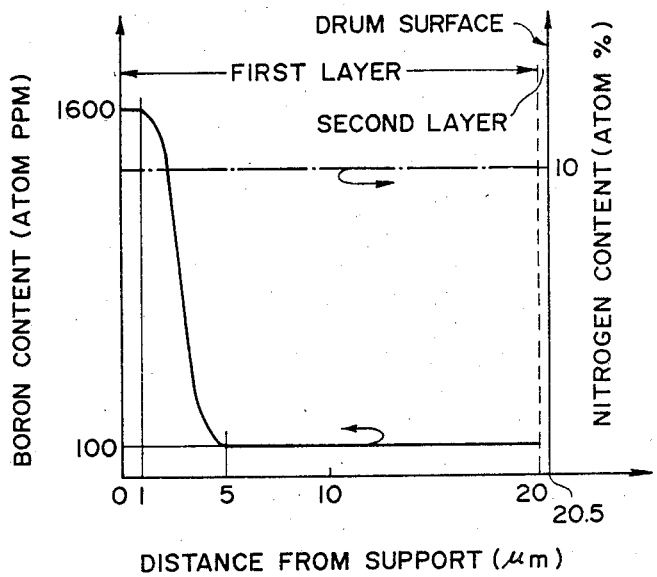

Drum-shaped photoconductive members were prepared according to the same procedure as in Example 1 except that the depth profiles of nitrogen atoms and boron atoms were changed as shown in FIG. 6 (Comparative example 1) and FIGS. 7–9 (Examples 3–5). For these photoconductive members, the same image evaluations as in Example 1 were practiced. As the result, image defects were relatively much in the drum-shaped photoconductive member of Comparative example 1, and image flow also occurred under high temperature and high humidity conditions. On the other hand, for the drum-shaped photoconductive members of Examples 3–5, well-contrasted images free from image defect were obtained both initially and after successive copying, and no image flow occurred even under high temperature and high humidity conditions.

EXAMPLE 6

On the drum-shaped photoconductive members, of which first layers were formed following the same conditions and the procedures as described in Examples 1, 2 and 3, second layers were formed according to the sputtering 3ethod as described in detail in German OLS 1136141 under the conditions as indicated in Table 3–1, respectively, to prepare 9 kinds of samples, and also 15 kinds of samples were prepared by forming second layers according to the same glow discharge method as described in Example 1 except for changing the respective conditions as indicated in Table 3–2 on the same drum-shaped light receiving members as mentioned above (24 samples as total of 6-1-1 - 6-1-8, 6-2-1 - 6-2-8 and 6-3-1 - 6-3-8).

Each of the image forming members for electrophotography was set individually in a copying device, subjected to corona charging at ⊖ 5.0 KV for 0.2 sec., followed by irradiation of a light image. As the light source, a tungsten lamp was used as a dosage of 1.0 lux.sec. The latent image was developed with a positively charged developer (containing toner and carrier) and transferred onto conventional paper. The transferred image was very good. The toner remaining on the image forming member for electrophotography was cleaned with a rubber blade. Even when such steps were repeated for 100,000 times or more, no image deterioration was observed in any case.

The results of overall image evaluation of the transferred image and evaluation of durability by successive continuous usage are given in Table 4.

EXAMPLE 7

Image forming members were formed according to entirely the same procedure as in Example 1 except that during formation of the second layer according to the sputtering method, the content ratio of silicon atoms to carbon atoms in the second layer was changed by varying the target area ratio of silicon wafer to graphite. For each of the image members thus formed, the same steps of image formation, developing and cleaning as in Example 1 were repeated 100,000 times, and thereafter image evaluation was conducted to obtain the results as shown in Table 5.

EXAMPLE 8

Image forming members were formed according to entirely the same procedure as in Example 1 except that, during formation of the second layer, the content ratio of silicon atoms to carbon atoms in the second layer was changed by varying the flow rate ratio of $SiH_4$ gas to $C_2H_4$ gas. For each of the image members thus formed, the same steps of image formation, developing and cleaning as in Example 1 were repeated 100,000 times, and thereafter image evaluation was conducted to obtain the results as shown in Table 6.

EXAMPLE 9

Image forming members were formed according to entirely the same procedure as in Example 1 except that, during formation of the second layer, the content ratio of silicon atoms to carbon atoms in the second layer was changed by varying the flow rate ratio of $SiH_4$ gas, $SiF_4$ gas and $C_2H_4$ gas. For each of the image members thus foprmed, the same steps of image formation, developing and cleaning as in Example 1 were repeated 100,000 times, and thereafter image evaluation was conducted to obtain the results as shown in Table 7.

TABLE 1

| Layer constitution | First layer | Second layer |
|---|---|---|
| Gases employed and their flow rates (SCCM) | $SiH_4$: 500<br>$B_2H_6$: 0.6→0.03<br>(Continuously changed)<br>$NH_3$: 18 | $SiH_4$: 100<br>He: 200<br>$CH_4$: 235 |
| Discharging power ($W/cm^2$) | 0.18 | 0.18 |
| Layer forming speed (Å/sec) | 19 | 10 |
| Layer thickness (μm) | 20 | 0.5 |
| Pressure during the reaction (torr) | 0.35 | 0.3 |
| Substrate temperature (°C.) | 250 | 200 |
| Discharging frequency (MHz) | 13.56 | 13.56 |

TABLE 2

| Layer constitution | First layer | Second layer |
|---|---|---|
| Gases employed and their flow rates (SCCM) | $SiH_4$: 300<br>$B_2H_6$: 0.5→0.02<br>(Continuously changed)<br>$NH_3$: 15<br>$H_2$: 900 | $SiH_4$: 100<br>He: 200<br>$CH_4$: 235 |
| Discharging power ($W/cm^2$) | 0.18 | 0.18 |
| Layer forming speed (Å/sec) | 14 | 10 |
| Layer thickness (μm) | 20 | 0.5 |
| Pressure during the reaction (torr) | 0.75 | 0.3 |
| Substrate temperature (°C.) | 250 | 200 |
| Discharging frequency (MHz) | 13.56 | 13.56 |

TABLE 3-1

| Condition | Si wafer: graphite (area ratio) | Discharging power ($W/cm^2$) | Layer thickness (μm) |
|---|---|---|---|
| 6-1 | 1.5:8.5 | 0.3 | 0.5 |
| 6-2 | 0.5:9.5 | 0.3 | 0.3 |
| 6-3 | 6:4 | 0.3 | 1.0 |

During sputtering, Ar was supplied at 200 SCCM.

TABLE 3-2

| Condition | Gases employed and their flow rates (SCCM) | Discharging power ($W/cm^2$) | Layer thickness (μm) |
|---|---|---|---|
| 6-4 | $SiH_4/He^{*1}$: 30<br>$CH_4$: 360 | 0.18 | 0.1 |
| 6-5 | $SiH_4/He^{*2}$: 150<br>$CH_4$: 100 | 0.18 | 0.3 |
| 6-6 | $SiH_4/He^{*2}$: 225<br>$SiF_4/He^*$: 225<br>$CH_4$: 350 | 0.18 | 0.5 |
| 6-7 | $SiH_4/He^{*2}$: 34<br>$SiF_4/He^*$: 11<br>$CH_4$: 1080 | 0.18 | 0.3 |
| 6-8 | $SiH_4/He^{*2}$: 225<br>$SiF_4/He^*$: 225<br>$CH_4$: 100 | 0.18 | 1.5 |

$^{*1}SiH_4/He = 1$, $^{*2}SiH_4/He = 0.5$,
$^{*}SiF_4/He = 0.5$

TABLE 4

| Preparation conditions for second layer | Sample No./Evaluation | | |
|---|---|---|---|
| 6-1 | 6-1-1<br>○ ○ | 6-2-1<br>○ ○ | 6-3-1<br>○ ○ |
| 6-2 | 6-1-2<br>○ ○ | 6-2-2<br>○ ○ | 6-3-2<br>○ ○ |
| 6-3 | 6-1-3<br>○ ○ | 6-2-3<br>○ ○ | 6-3-3<br>○ ○ |
| 6-4 | 6-1-4<br>⊙ ⊙ | 6-2-4<br>⊙ ⊙ | 6-3-4<br>⊙ ⊙ |
| 6-5 | 6-1-5<br>⊙ ⊙ | 6-2-5<br>⊙ ⊙ | 6-3-5<br>⊙ ⊙ |
| 6-6 | 6-1-6<br>⊙ ⊙ | 6-2-6<br>⊙ ⊙ | 6-3-6<br>⊙ ⊙ |
| 6-7 | 6-1-7<br>○ ○ | 6-2-7<br>○ ○ | 6-3-7<br>○ ○ |
| 6-8 | 8-1-8<br>○ ○ | 8-6-8<br>○ ○ | 8-7-8<br>○ ○ |

Sample No.

Overall image evaluation  Durability evaluation

Evaluation standard:
⊙. . Excellent
○. . . Good

TABLE 5

| Sample No. | 701 | 702 | 703 | 704 | 705 | 706 | 707 |
|---|---|---|---|---|---|---|---|
| Si:C (area ratio) | 9:1 | 6.5:3.5 | 4:6 | 2:8 | 1:9 | 0.5:9.5 | 0.2:9.8 |
| Si:C (Content ratio) | 9.7:0.3 | 8.8:1.2 | 7.3:2.7 | 4.8:5.2 | 3:7 | 2:8 | 0.8:9.2 |
| Image evaluation | Δ | ○ | ⊙ | ⊙ | ○ | Δ | X |

⊙: Very good
○ : Good
Δ: Practically satisfactory
X: Image defect formed

TABLE 6

| Sample No. | 801 | 802 | 803 | 804 | 805 | 806 | 807 | 808 |
|---|---|---|---|---|---|---|---|---|
| Si: $C_2H_4$ (Flow rate ratio) | 9:1 | 6:4 | 4:6 | 2:8 | 1:9 | 0.5:9.5 | 0.35:9.65 | 0.2:9.8 |
| Si:C (Content ratio) | 9:1 | 7:3 | 5.5:4.5 | 4:6 | 3:7 | 2:8 | 1.2:8.8 | 0.8:9.2 |
| Image evaluation | ○ | ○ | ⊙ | ⊙ | ⊙ | ○ | Δ | X |

⊙: Very good
○: Good
Δ: Practically satisfactory
X: Image defect formed

TABLE 7

| Sample No. | 901 | 902 | 903 | 904 | 905 | 906 | 907 | 908 |
|---|---|---|---|---|---|---|---|---|
| $SiH_4$:$SiF_4$:$C_2H_4$ (Flow rate ratio) | 5:4:1 | 3:3.5:3.5 | 2:2:6 | 1:1:8 | 0.6:0.4:9 | 0.2:0.3:9.5 | 0.2:0.15:9.65 | 0.1:0.1:9.8 |
| Si:C (Content ratio) | 9:1 | 7:3 | 5.5:4.5 | 4:6 | 3:7 | 2:8 | 1.2:8.8 | 0.8:9.2 |
| Image evaluation | Δ | ○ | ⊙ | ⊙ | ⊙ | ○ | Δ | X |

⊙: Very good
○: Good
Δ: Practically satisfactory
X: Image defect formed

What is claimed is:

1. A photoconductive member, having a support, a first layer having photoconductivity containing an amorphous material comprising silicon atoms as a matrix provided on said support and a second layer containing silicon atoms and carbons atoms as essential components provided on said first layer, wherein said first layer contains at least one kind of atoms selected from the group III of the periodic table together with nitrogen atoms, with the nitrogen atoms having a substantially uniform concentration distribution within said first layer where the content of nitrogen atoms is 0.005 to 40 atomic % and the group III atoms of the periodic table having a depth concentration profile of said atoms with respect to the layer thickness direction where the maximum concentration is at the end surface on the side of said support or in the vicinity thereof and the concentration of said atoms tends to decrease continuously toward the second layer, and where the concentration distribution maximum of the group III atoms of the periodic table is in the range from 80 to $1\times10^5$ atomic ppm, the concentration distribution minimum of the group III atoms of the periodic table is in the range from 1 to 1000 atomic ppm and the maximum of the concentration distribution is 2 times or more relative to the minimum of the concentration distribution.

2. A photoconductive member according to claim 1, wherein hydrogen atoms are contained in the first layer.

3. A photoconductive member according to claim 2, wherein the content of hydrogen atoms is in the range from 1 to 40 atomic %.

4. A photoconductive member according to claim 1, wherein halogen atoms are contained in the first layer.

5. A photoconductive member according to claim 4, wherein the content of halogen atoms is in the range from 1 to 40 atomic %.

6. A photoconductive member according to claim 1, wherein both of hydrogen atoms and halogen atoms are contained in the first layer.

7. A photoconductive member according to claim 6, wherein the content in sum of hydrogen atoms and halogen atoms is in the range from 1 to 40 atomic %.

8. A photoconductive member according to claim 1, wherein the group III atoms of the periodic table are selected from the group consisting of boron, aluminum, gallium, indium and thallium.

9. A photoconductive member according to claim 1, wherein the support is electrically conductive.

10. A photoconductive member according to claim 1, wherein the support is electrically insulating.

11. A photoconductive member according to claim 13, wherein the surface of the support is electrically conductive.

12. A photoconductive member according to claim 1, wherein the support has a drum-like shape.

13. A photoconductive member according to claim 1, wherein the support is shaped in a belt.

14. A photoconductive member according to claim 1, wherein hydrogen atoms are contained in the second layer.

15. A photoconductive member according to claim 1, wherein halogen atoms are contained in the second layer.

16. A photoconductive member according to claim 1, wherein hydrogen atoms and halogen atoms are contained in the second layer.

17. A photoconductive member according to claim 1, wherein the content of carbon atoms is in the range from $1\times10^{-3}$ to 90 atomic %.

18. A photoconductive member according to claim 1, wherein the layer thickness of the second layer is in the range from 0.003 to 30 $\mu$m.

* * * * *

UNITED STATES PATENT AND TRADEMARK OFFICE

CERTIFICATE OF CORRECTION

PATENT NO. : 4,592,985

DATED : June 3, 1986

INVENTOR(S) : KYOSUKI OGAWA, ET AL.

It is certified that error appears in the above-identified patent and that said Letters Patent is hereby corrected as shown below:

COLUMN 15

Line 26, "3ethod" should read --method--.
Line 27, "1136141" should read --3136141--.

COLUMN 16

Line 18, "foprmed" should read --formed--.

COLUMN 18

Line 48, "carbons" should read --carbon--.

COLUMN 20

Line 4, "13" should read --10--.

Signed and Sealed this

Tenth Day of February, 1987

*Attest:*

*Attesting Officer*

DONALD J. QUIGG

*Commissioner of Patents and Trademarks*